US011054776B2

(12) United States Patent
Hironaka

(10) Patent No.: US 11,054,776 B2
(45) Date of Patent: Jul. 6, 2021

(54) FIXING DEVICE, IMAGE FORMING APPARATUS, AND FIXING METHOD

(71) Applicant: Konica Minolta Inc., Tokyo (JP)

(72) Inventor: Motoki Hironaka, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/900,642

(22) Filed: Jun. 12, 2020

(65) Prior Publication Data

US 2021/0003950 A1 Jan. 7, 2021

(30) Foreign Application Priority Data

Jul. 4, 2019 (JP) ..... JP2019-125180

(51) Int. Cl.
*G03G 15/20* (2006.01)
*G03G 15/00* (2006.01)

(52) U.S. Cl.
CPC ..... *G03G 15/2053* (2013.01); *G03G 15/2039* (2013.01); *G03G 15/2064* (2013.01); *G03G 15/205* (2013.01); *G03G 15/6585* (2013.01)

(58) Field of Classification Search
CPC ..... G03G 15/2053; G03G 15/6585; G03G 15/2039; G03G 15/205
See application file for complete search history.

(56) References Cited

U.S. PATENT DOCUMENTS 6,243,559 B1 * 6/2001 Kurotaka ..... G03G 15/2064 219/216
6,795,681 B2 * 9/2004 Onodera ..... G03G 15/2039 399/329
2011/0194869 A1 * 8/2011 Yoshinaga ..... G03G 15/2064 399/69

FOREIGN PATENT DOCUMENTS

JP 2001-002557 A 1/2001
JP 2016-133766 A 7/2016

* cited by examiner

*Primary Examiner* — Arlene Heredia
(74) *Attorney, Agent, or Firm* — Squire Patton Boggs (US) LLP

(57) ABSTRACT

A fixing device includes: a fixing-surface-side member disposed on a fixing surface side on which a toner image is to be formed in a recording medium; a back-surface-side support member that is disposed on an opposite surface side to the fixing surface in the recording medium, and forms a fixing nip that nips and conveys the recording medium with the fixing-surface-side member; a heat source that heats the toner image formed on the recording medium passing through the fixing nip; a nip time changing part that can change a nip time that is a time required for the recording medium to pass through the fixing nip; and a hardware processor that controls the nip time changing part and the heat source to shorten the nip time and increase a fixing temperature of the toner image, and to lengthen the nip time and lower a fixing temperature of the toner image.

8 Claims, 10 Drawing Sheets

FIG. 5

| | LOW GLOSSINESS MODE | NORMAL MODE | HIGH GLOSSINESS MODE |
|---|---|---|---|
| FIXING TEMPERATURE | 194°C | 184°C | 174°C |
| NIP TIME | 33ms | 46ms | 50ms |
| NIP WIDTH | 15mm | 21mm | 27mm |
| SHEET PASSING LINEAR SPEED | 460mm/s | 460mm/s | 460mm/s |

RELATIONSHIP BETWEEN SURFACE HARDNESS AND GLOSSINESS DIFFERENCE

FIG. 10

| | BELT HARDNESS LOW | BELT HARDNESS MEDIUM | BELT HARDNESS HIGH | COMPARATIVE EXAMPLE 1 | COMPARATIVE EXAMPLE 2 |
|---|---|---|---|---|---|
| FIXING PROPERTY | ○ | ○ | ○ | × | ○ |
| PRODUCTIVITY | ○ | ○ | ○ | ○ | × |
| GLOSS CONTROL | △ | ○ | △ | ○ | ○ |

RELATIONSHIP BETWEEN NIP WIDTH, BELT TENSION, AND NIP PRESSURE

FIXING DEVICE, IMAGE FORMING APPARATUS, AND FIXING METHOD

The entire disclosure of Japanese patent Application No. 2019-125180, filed on Jul. 4, 2019, is incorporated herein by reference in its entirety.

BACKGROUND

Technological Field

The present invention relates to a fixing device, an image forming apparatus, and a fixing method.

Description of the Related Art

For example, a fixing device includes: a fixing-surface-side member disposed on a fixing surface (a surface formed with a toner image) side of a recording medium such as a sheet; a back-surface-side support member disposed on a back surface (a surface opposite to the fixing surface) side of the recording medium; a heat source; and the like. Usually, by direct or indirect pressure contact between a pressure roller included in the fixing-surface-side member and a pressure roller included in the back-surface-side support member, a fixing nip that holds and conveys the recording medium is formed. By heating, nipping, and conveying the recording medium with the fixing nip, an unfixed toner image can be fixed on the recording medium.

For example, it is known to lower a nip pressure of the fixing nip, as a means that reduces glossiness of a toner image fixed on the recording medium. Lowering the nip pressure reduces a length (a nip width) of the recording medium in a conveyance direction in the fixing nip. This reduces a heating amount for heating toner while the recording medium passes through the fixing nip. As a result, a toner shape tends to remain, and the glossiness of the image decreases.

Further, it is also known that lowering a fixing temperature of toner reduces a heating amount for heating the toner while the recording medium passes through the fixing nip, which lowers the glossiness.

On the other hand, increasing a nip pressure and increasing a fixing temperature are known as means that increase the glossiness.

For example, JP 2001-2557 A discloses a means that controls glossiness on the basis of a speed (a sheet passing linear speed) and a nip pressure when a recording medium passes through a fixing nip.

Note that, if a heating amount for toner is excessively reduced in order to lower glossiness, a fixing failure may occur. For example, JP 2016-133766 A discloses lowering a sheet passing linear speed and lowering a nip pressure, as a means that achieves low glossiness while inhibiting an occurrence of a fixing failure.

However, in the fixing device described in JP 2001-2557 A, when the glossiness is controlled to be lowered on the basis of the sheet passing linear speed and the nip pressure, a heating amount for toner may be insufficient, resulting in a fixing failure. Further, there has been a problem that productivity is lowered in lowering the sheet passing linear speed for increasing the glossiness.

Further, in the fixing device described in JP 2016-133766 A, there has been a problem that productivity is lowered when the sheet passing linear speed is lowered in order to achieve low glossiness.

SUMMARY

An object of the present invention is to provide a fixing device, an image forming apparatus, and a fixing method capable of suppressing a decrease in productivity and an occurrence of a fixing failure when controlling glossiness.

To achieve the abovementioned object, according to an aspect of the present invention, a fixing device reflecting one aspect of the present invention comprises: a fixing-surface-side member disposed on a fixing surface side on which a toner image is to be formed in a recording medium; a back-surface-side support member that is disposed on an opposite surface side to the fixing surface in the recording medium, and forms a fixing nip that nips and conveys the recording medium with the fixing-surface-side member; a heat source that heats the toner image formed on the recording medium passing through the fixing nip; a nip time changing part that can change a nip time that is a time required for the recording medium to pass through the fixing nip; and a hardware processor that controls the nip time changing part and the heat source to shorten the nip time and increase a fixing temperature of the toner image when glossiness of the toner image fixed on the recording medium is made lower than a predetermined value, and to lengthen the nip time and lower a fixing temperature of the toner image when glossiness of the toner image is made higher than a predetermined value.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 5 is a view showing an example of fixing conditions such as a fixing temperature in each glossiness mode;

FIG. 10 is a view showing a fixing property, productivity, and gloss control when the surface hardness of the fixing belt is low, medium, and high, and in Comparative Examples 1 and 2.

DETAILED DESCRIPTION OF EMBODIMENTS

Hereinafter, one or more embodiments of the present invention will be described with reference to the drawings.

Figure 1:
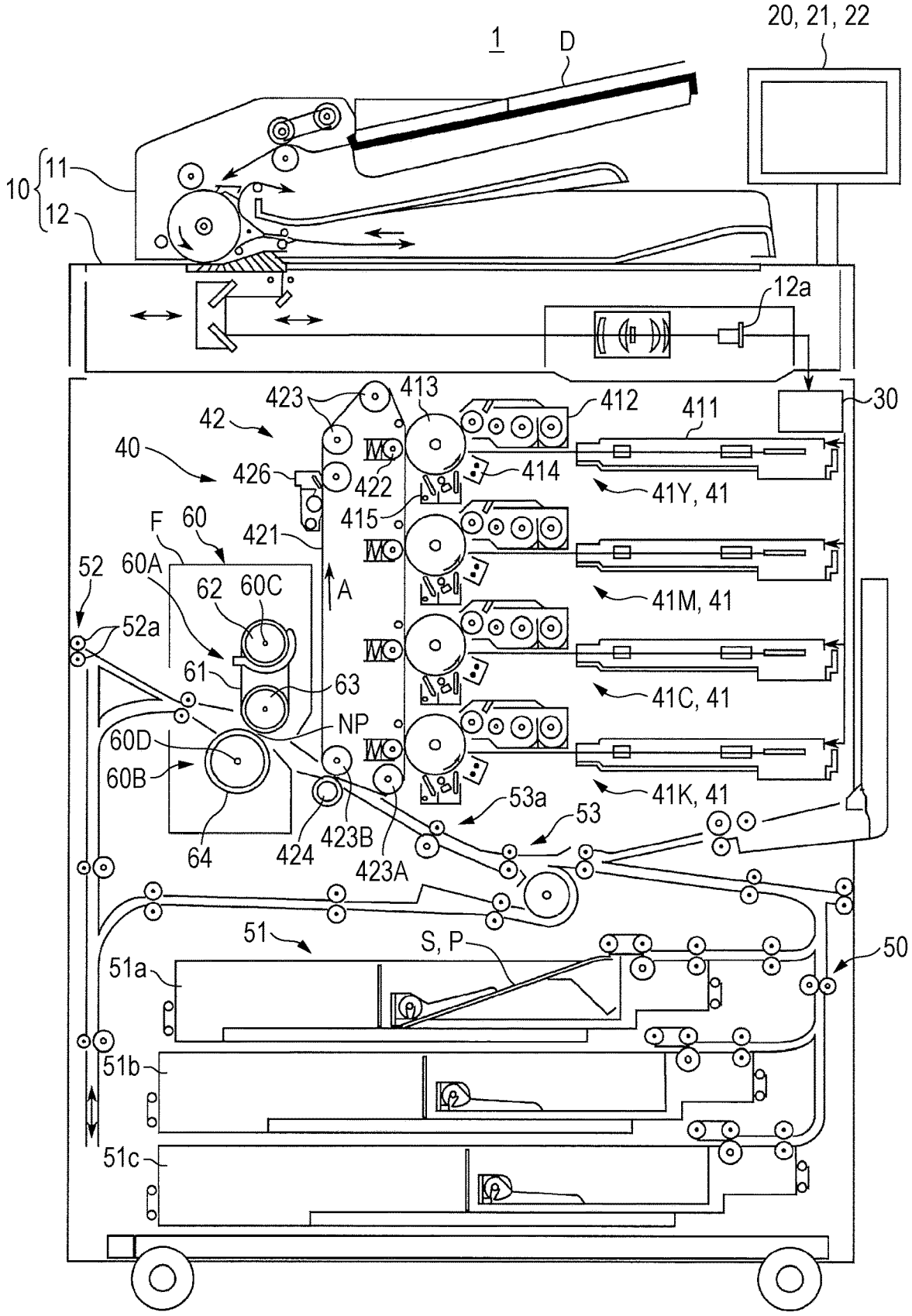
FIG. 1 is a view schematically showing an entire configuration of an image forming apparatus according to an embodiment of the present invention.
Figure 2:
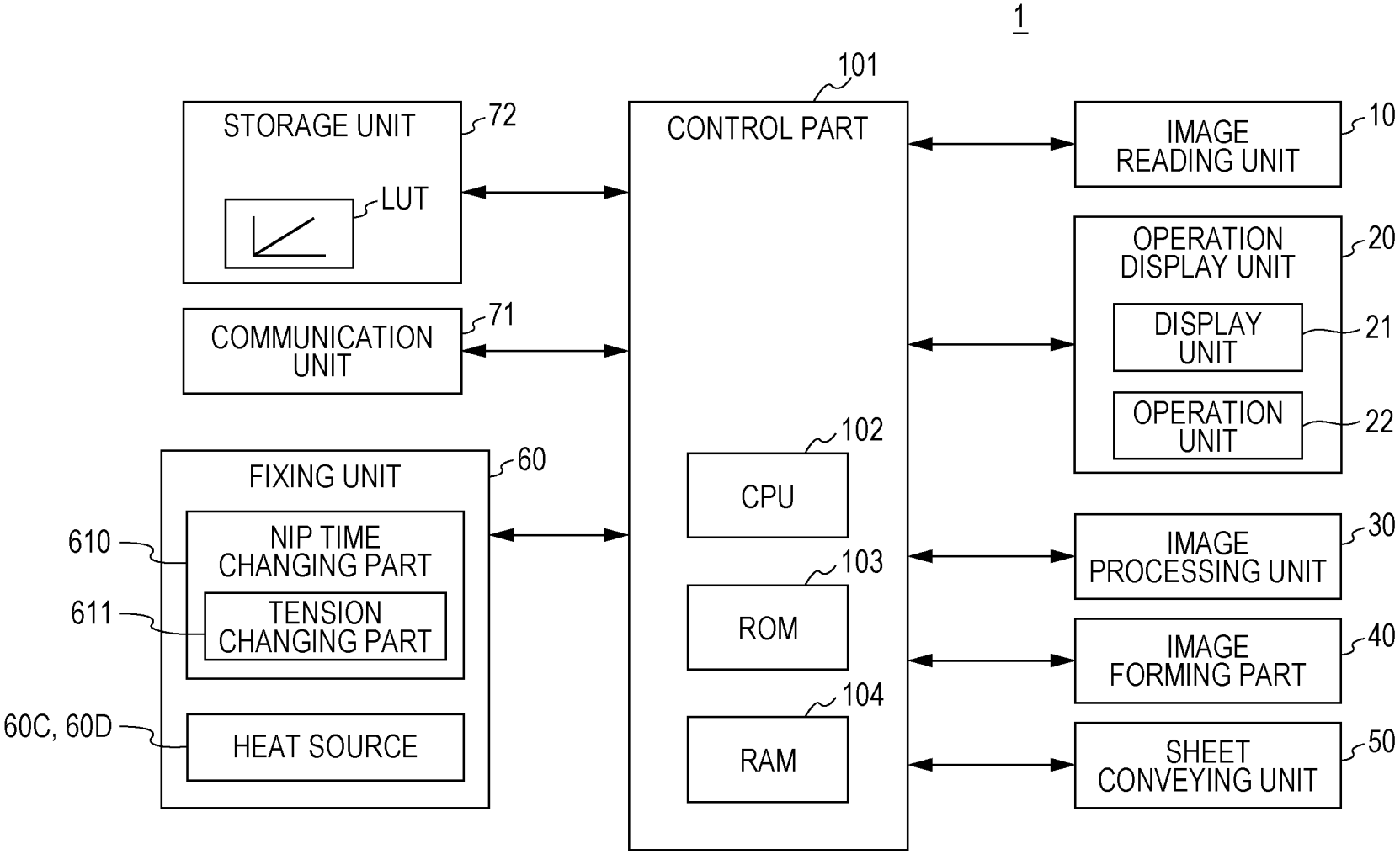
FIG. 2 is a diagram showing a main part of a control system of the image forming apparatus according to the present embodiment.

However, the scope of the invention is not limited to the disclosed embodiments. FIG. 1 is a view schematically showing an entire configuration of an image forming apparatus 1 according to an embodiment of the present invention. FIG. 2 is a diagram showing a main part of a control system of the image forming apparatus 1 according to the present embodiment. The image forming apparatus 1 shown in FIG. 1 is an intermediate-transfer color image forming apparatus using an electrophotographic process technology. That is, the image forming apparatus 1 primarily transfers respective color toner images of yellow (Y), magenta (M), cyan (C), and black (K) formed on a photosensitive drum 413 to an intermediate transfer belt 421, superimposes the four color toner images on the intermediate transfer belt 421, and then secondary transfers the toner images onto a sheet S (recording medium), to form a toner image.

Further, to the image forming apparatus 1, a tandem method is employed in which the photosensitive drums 413 corresponding to the four colors of YMCK are arranged in series in a traveling direction of the intermediate transfer belt 421, and toner images of the respective colors are sequentially transferred to the intermediate transfer belt 421 in a single procedure.

As shown in FIG. 2, the image forming apparatus 1 includes an image reading unit 10, an operation display unit 20, an image processing unit 30, an image forming part 40, a sheet conveying unit 50, a fixing unit 60, a control part 101, and the like.

The control part 101 includes a central processing unit (CPU) 102, a read only memory (ROM) 103, a random access memory (RAM) 104, and the like.

The CPU 102 reads a program according to processing contents from the ROM 103, develops the program in the RAM 104, and cooperates with the developed program to perform central control on an operation of each block of the image forming apparatus 1. At this time, various data stored in a storage unit 72 are referred to. The storage unit 72 is formed by, for example, a non-volatile semiconductor memory (so-called flash memory) or a hard disk drive.

The control part 101 exchanges various data with an external device (for example, a personal computer) connected to a communication network such as a local area network (LAN) or a wide area network (WAN) via a communication unit 71. For example, the control part 101 receives image data transmitted from an external device, and forms a toner image on the sheet S on the basis of the image data (input image data). The communication unit 71 is formed by, for example, a communication control card such as a LAN card.

The image reading unit 10 includes an automatic document feeding device 11 called an auto document feeder (ADF), a document image scanning device 12 (scanner), and the like.

The automatic document feeding device 11 conveys a document D placed on a document tray by a conveyance system, and sends the document D to the document image scanning device 12. The automatic document feeding device 11 can continuously read images (including both sides) at once of a large number of the documents D placed on the document tray.

The document image scanning device 12 optically scans a document conveyed onto a contact glass from the automatic document feeding device 11 or a document placed on the contact glass, and forms an image of reflected light from the document onto a light receiving surface of a charge coupled device (CCD) sensor 12*a*, to read the document image. The image reading unit 10 generates input image data on the basis of a reading result of the document image scanning device 12. The image processing unit 30 applies predetermined image processing to the input image data.

The operation display unit 20 is formed by, for example, a liquid crystal display (LCD) with a touch panel, and functions as a display unit 21 and an operation unit 22. The display unit 21 displays various operation screens, state display of an image, an operation status of each function, and the like in accordance with a display control signal inputted from the control part 101. The operation unit 22 includes various operation keys such as a ten key and a start key, receives various input operations by a user, and outputs an operation signal to the control part 101. Note that the input operations include an operation of selecting one of a normal mode, a low glossiness mode in which glossiness is lower than a predetermined value (a value of the normal mode), and a high glossiness mode in which glossiness is higher than a predetermined value.

The image processing unit 30 includes a circuit or the like that performs digital image processing according to initial setting or user setting, on the input image data. For example, the image processing unit 30 performs gradation correction on the basis of gradation correction data (gradation correction table) under the control of the control part 101. Further, the image processing unit 30 performs, on the input image data, various correction processes such as color correction and shading correction in addition to the gradation correction, compression processing, and the like. On the basis of the image data subjected to these processes, the image forming part 40 is controlled.

The image forming part 40 includes: image forming units 41Y, 41M, 41C, and 41K that form an image with respective color toners of a Y component, an M component, a C component, and a K component on the basis of input image data; an intermediate transfer unit 42; and the like.

The image forming units 41Y, 41M, 41C, and 41K for the Y component, the M component, the C component, and the K component have a similar configuration. For convenience of illustration and description, common constituents are denoted by the same reference numerals, and the individual constituents are indicated by adding Y, M, C or K to the reference numerals when being distinguished. In FIG. 1, reference numerals are given exclusively to the constituents of the image forming unit 41Y for the Y component, and reference numerals of the constituents of other image forming units 41M, 41C, and 41K are omitted.

The image forming unit 41 includes an exposure device 411, a developing device 412, the photosensitive drum 413, a charging device 414, a drum cleaning device 415, and the like.

The photosensitive drum 413 is, for example, a negative-charge organic photo-conductor (OPC) in which an undercoat layer (UCL), a charge generation layer (CGL), and a charge transport layer (CTL) are sequentially laminated on a peripheral surface of a conductive cylinder (aluminum tube) made of aluminum. The charge generation layer is formed by an organic semiconductor in which a charge generation material (for example, phthalocyanine pigment) is dispersed in a resin binder (for example, polycarbonate), and generates a pair of a positive charge and a negative charge by exposure with the exposure device 411. The charge transport layer is obtained by dispersing a hole transporting material (electron-donating nitrogen-containing compound) in a resin binder (for example, polycarbonate resin), and transports a positive charge generated in the charge generation layer to a surface of the charge transport layer.

The control part 101 controls a drive current supplied to a drive motor (not shown) that rotates the photosensitive drum 413, to rotate the photosensitive drum 413 at a constant peripheral speed.

The charging device 414 uniformly charges a surface of the photosensitive drum 413 having photoconductivity, with negative polarity. The exposure device 411 is formed by, for example, a semiconductor laser, and irradiates the photosensitive drum 413 with a laser beam corresponding to an image of each color component. A positive charge is generated in the charge generation layer of the photosensitive drum 413 and is transported to the surface of the charge transport layer, whereby a surface charge (negative charge) of the photosensitive drum 413 is neutralized. On the surface of the photosensitive drum 413, an electrostatic latent image of each color component is formed by a potential difference from the surroundings.

The developing device 412 is, for example, a developing device of a two-component developing system, and visualizes an electrostatic latent image to form a toner image by causing toner of each color component to adhere to the surface of the photosensitive drum 413.

The drum cleaning device 415 has a drum cleaning blade or the like that is slidably in contact with the surface of the photosensitive drum 413, and removes transfer residual toner remaining on the surface of the photosensitive drum 413 after primary transfer.

The intermediate transfer unit 42 includes the intermediate transfer belt 421, a primary transfer roller 422, a plurality of support rollers 423, a secondary transfer roller 424, a belt cleaning device 426, and the like.

The intermediate transfer belt 421 is formed by an endless belt, and is stretched in a loop around the plurality of support rollers 423. At least one of the plurality of support rollers 423 is formed by a drive roller, and others are formed by a driven roller. For example, it is desirable that a roller 423A disposed downstream of the primary transfer roller 422 for the K component in a belt traveling direction is the drive roller. This makes it easy to keep a constant traveling speed of the belt in a primary transfer unit. As the drive roller 423A rotates, the intermediate transfer belt 421 travels at a constant speed in an arrow A direction.

The primary transfer roller 422 is disposed on an inner peripheral surface side of the intermediate transfer belt 421, so as to face the photosensitive drum 413 of each color component. By pressure contact of the primary transfer roller 422 and the photosensitive drum 413 with the intermediate transfer belt 421 interposed in between, the primary transfer nip for transfer of a toner image from the photosensitive drum 413 to the intermediate transfer belt 421 is formed.

The secondary transfer roller 424 is disposed on an outer peripheral surface side of the intermediate transfer belt 421, so as to face a backup roller 423B disposed on downstream of the drive roller 423A in the belt traveling direction. By pressure contact of the secondary transfer roller 424 and the backup roller 423B with the intermediate transfer belt 421 interposed in between, a secondary transfer nip for transfer of a toner image from the intermediate transfer belt 421 to the sheet S is formed.

When the intermediate transfer belt 421 passes through the primary transfer nip, the toner image on the photosensitive drum 413 is sequentially superimposed and primarily transferred on the intermediate transfer belt 421. Specifically, by applying a primary transfer bias to the primary transfer roller 422, and supplying a charge of a polarity opposite to that of the toner to a back surface side of the intermediate transfer belt 421 (a side in contact with the primary transfer roller 422), the toner image is electrostatically transferred to the intermediate transfer belt 421.

Thereafter, when the sheet S passes through the secondary transfer nip, the toner image on the intermediate transfer belt 421 is secondarily transferred to the sheet S. Specifically, by applying a secondary transfer bias to the secondary transfer roller 424 and applying a charge having a polarity opposite to that of toner to the back surface side of the sheet S (a side in contact with the secondary transfer roller 424), a toner image is electrostatically transferred to the sheet S. The sheet S transferred with the toner image is conveyed toward the fixing unit 60.

The belt cleaning device 426 has a belt cleaning blade or the like that is slidably in contact with a surface of the intermediate transfer belt 421, and removes transfer residual toner remaining on the surface of the intermediate transfer belt 421 after the secondary transfer. Note that, instead of the secondary transfer roller 424, a configuration (a so-called belt secondary transfer unit) may be employed in which the secondary transfer belt is stretched in a loop around a plurality of support rollers including a secondary transfer roller.

The fixing unit 60 includes: an upper fixing unit 60A having a fixing-surface-side member disposed on a fixing surface (a surface formed with a toner image) side of the sheet S; a lower fixing unit 60B having a back-surface-side support member disposed on a back surface (a surface opposite to the fixing surface) side of the sheet S; a heat source 60C; and the like. By pressure contact of the back-surface-side support member and the fixing-surface-side member, a fixing nip to hold and convey the sheet S is formed. The fixing unit 60 and the control part 101 correspond to a fixing device of the present invention.

The fixing unit 60 fixes a toner image onto the sheet S by heating and pressurizing, with the fixing nip, the sheet S on which the toner image has been secondarily transferred and that has been conveyed. The fixing unit 60 is disposed as a unit in the fixing device, that is, a housing F.

The sheet conveying unit 50 includes a sheet feeding unit 51, a sheet discharging unit 52, a conveyance path unit 53, and the like. In three sheet feeding tray units 51*a* to 51*c* forming the sheet feeding unit 51, the sheets S (standard sheets, special sheets) identified on the basis of a basis weight, a size, and the like are accommodated for each preset type. The conveyance path unit 53 has a plurality of conveying rollers such as a registration roller pair 53*a*.

The sheets S accommodated in the sheet feeding tray units 51*a* to 51*c* are fed one by one from the top and conveyed to the image forming part 40 by the conveyance path unit 53. At this time, a registration roller unit disposed with the registration roller pair 53*a* corrects an inclination of the fed sheet S and adjusts conveyance timing. Then, the toner image of the intermediate transfer belt 421 is secondarily transferred collectively on one side of the sheet S in the image forming part 40, and a fixing process is performed in the fixing unit 60. The sheet S formed with an image is discharged outside the apparatus by the sheet discharging unit 52 provided with a sheet discharge roller 52*a*.

Next, a configuration of the fixing unit 60 will be described in more detail.

The upper fixing unit 60A includes an endless fixing belt 61, which is the fixing-surface-side member, a heating roller 62, and an upper pressure roller 63 (belt heating method). The fixing belt 61 is stretched between the heating roller 62 and the upper pressure roller 63 under a predetermined tension (for example, 400 N). Hereinafter, the tension of the fixing belt 61 is referred to as "belt tension".

The fixing belt 61 is made by covering an outer peripheral surface of a base made of polyimide (PI), for example, with a heat-resistant silicone rubber as an elastic layer, and covering or coating a surface layer with a tube of peffluoroalkoxy (PFA), which is a heat resistant resin.

The fixing belt 61 comes into contact with the sheet S formed with a toner image, and performs heat fixing on the toner image to the sheet S in a predetermined temperature range.

The heating roller 62 heats the fixing belt 61. The heating roller 62 incorporates the heat source 60C that is a halogen heater, for example, for heating the fixing belt 61. The heating roller 62 has a configuration in which an outer peripheral surface of a cylindrical core metal made of aluminum or the like is covered with a resin layer coated with PTFE.

A temperature of the heat source 60C is controlled by the control part 101. The heating roller 62 is heated by the heat source 60C, and as a result, the fixing belt 61 is heated. This causes the toner formed on the sheet S to be heated. The control part 101 controls a fixing temperature of the toner by, for example, controlling the heat source 60C on the basis of an ON/OFF pattern in half-wave units with a predetermined duty ratio, and controlling the fixing belt 61 to a predetermined temperature. Note that the control part 101 may control the heat source 60C on the basis of a detection result of a temperature sensor that detects a surface temperature of the toner.

The upper pressure roller 63 is obtained by covering a solid core metal made of metal such as iron, with an elastic layer. As a material of the elastic layer, for example, heat-resistant silicon rubber can be used. Further, the elastic layer may have a configuration in which heat-resistant silicone rubber is covered with a resin layer coated with PTFE, which is low-friction and heat-resistant resin.

The lower fixing unit 60B has a lower pressure roller 64 included in the back-surface-side support member (roller pressure method). The lower pressure roller 64 is obtained by covering an outer peripheral surface of a base material layer made of aluminum (Al) with an elastic layer. As a material of the elastic layer, for example, heat-resistant silicon rubber can be used. Further, the elastic layer may have a configuration in which heat-resistant silicone rubber is covered with a resin layer of a PFA tube as a surface release layer.

The lower pressure roller 64 incorporates a heat source 60D such as a halogen heater. By the heat source 60D generating heat, the lower pressure roller 64 is heated. This causes the toner formed on the sheet S to be heated. The control part 101 controls a fixing temperature of the toner by, for example, controlling the heat source 60D on the basis of an ON/OFF pattern in half-wave units with a predetermined duty ratio, and controlling the lower pressure roller 64 to a predetermined temperature. Note that the control part 101 may control the heat source 60D, for example, on the basis of a detection result of a temperature sensor that detects a surface temperature of the toner.

The lower pressure roller 64 is pressure-contacted against the upper pressure roller 63 via the fixing belt 61 with a predetermined fixing load. In this way, a fixing nip NP that nips and conveys the sheet S is formed between the lower pressure roller 64, and the upper pressure roller 63 and the fixing belt 61.

The lower pressure roller 64 is connected to an actuator (not shown) such as a motor and a gear, and a driving force of the motor is transmitted to the lower pressure roller 64. The control part 101 outputs a drive signal to a motor that drives the lower pressure roller 64, to control a peripheral speed of the lower pressure roller 64.

In the fixing unit 60, the upper fixing unit 60A, the lower fixing unit 60B, and the heat sources 60C and 60D fix an unfixed toner image on the sheet S, by conveying the sheet S (recording medium) while heating and pressurizing with the fixing nip NP.

Meanwhile, there is a means that lowers a nip pressure of the fixing nip NP in order to reduce glossiness of the toner image fixed on the sheet S. By lowering a nip pressure, the nip width is reduced. This reduces a heating amount for heating the toner while the sheet S passes through the fixing nip NP. For this reason, there has been a problem that a toner shape tends to remain and glossiness of an image is reduced. Further, there has also been a problem that a fixing failure may occur when the heating amount for the toner is insufficient.

Further, there has been a problem that productivity is lowered when a sheet passing linear speed is lowered in order to achieve low glossiness while inhibiting an occurrence of a fixing failure.

Therefore, the fixing unit 60 according to the present embodiment includes a nip time changing part 610. Note that a time required for the sheet S (recording medium) to pass through the fixing nip NP is referred to as "nip time". The nip time is expressed as a value obtained by dividing a nip width by the sheet passing linear speed.

Figure 3:
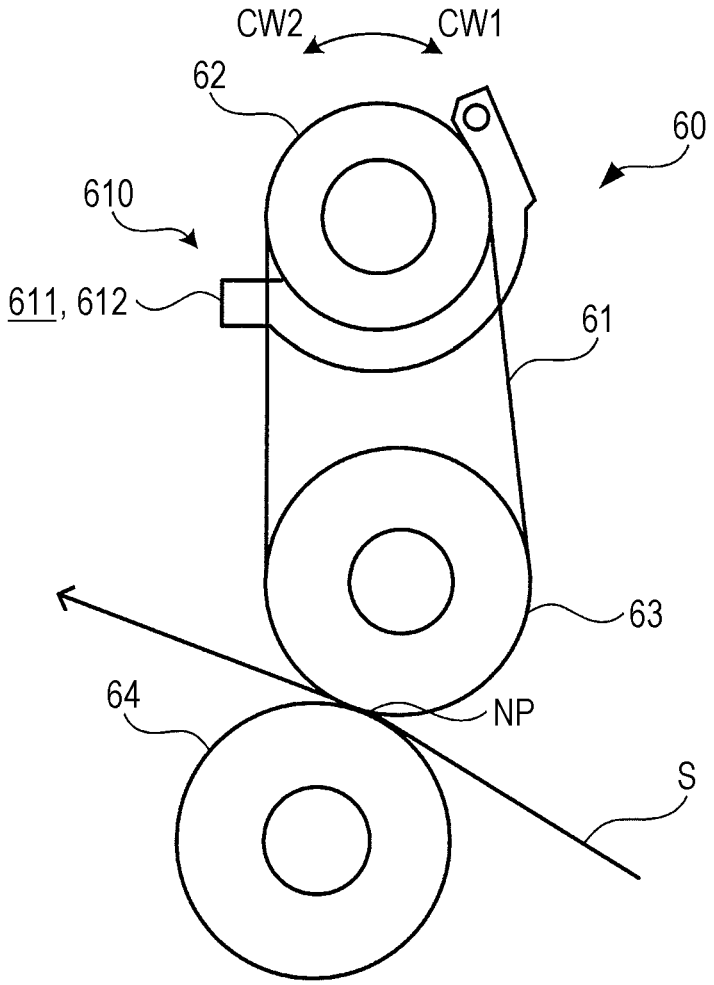
FIG. 3 is a view schematically showing an example of a fixing unit according to the present embodiment.

FIG. 3 is a view schematically showing an example of the fixing unit 60 according to the present embodiment.

The nip time changing part 610 has a tension changing part 611 that can change a nip width by changing a belt tension (tension of the fixing belt 61), as shown in FIGS. 2 and 3. The tension changing part 611 has an arm 612 and an actuator (not shown).

The arm 612 is engaged with, for example, a rotation shaft of the heating roller 62, as shown in FIG. 3. One end of the arm 612 extends to the right of the heating roller 62. One end of the arm 612 is rotatably supported by the housing F. Another end the arm 612 extends to the left of the heating roller 62.

When the arm 612 rotates in a clockwise direction CW1 with one end serving as a fulcrum, the heating roller 62 moves upward. This causes the heating roller 62 to be separated from the upper pressure roller 63, which increases the belt tension.

When the arm 612 rotates in a counterclockwise direction CW2 with one end serving as a fulcrum, the heating roller 62 moves downward. This causes the heating roller 62 to come closer to the upper pressure roller 63, which reduces the belt tension.

The actuator is formed by a known means. The actuator moves another end of the arm 612 in a vertical direction so as to change the belt tension, for example, by causing the heating roller 62 to come closer to or to be separated from the upper pressure roller 63.

When the belt tension is changed, the nip pressure changes and the nip width changes, and as a result, the nip time changes. Specifically, when the belt tension increases, the nip pressure decreases and the nip width decreases, which shortens the nip time. As a result, by melting the toner in a short period of time, the toner shape is likely to remain, and the glossiness is reduced.

Conversely, when the belt tension decreases, the nip pressure increases and the nip width increases, which lengthens the nip time. As a result, by melting the toner over a long period of time, the toner shape is less likely to remain, and the glossiness increases.

When the glossiness is lower than a predetermined value (a value in the normal mode), the control part 101 controls the nip time changing part 610 so as to increase the belt tension and shorten the nip time, and controls the heat sources 60C and 60D so as to increase the fixing temperature of the toner.

Further, when the glossiness is higher than a predetermined value, the control part 101 controls the nip time changing part 610 so as to reduce the belt tension and lengthen the nip time, and controls the heat sources 60C and 60D so as to lower the fixing temperature of the toner.

Next, a fixing method according to the present embodiment will be described.

Figure 4:
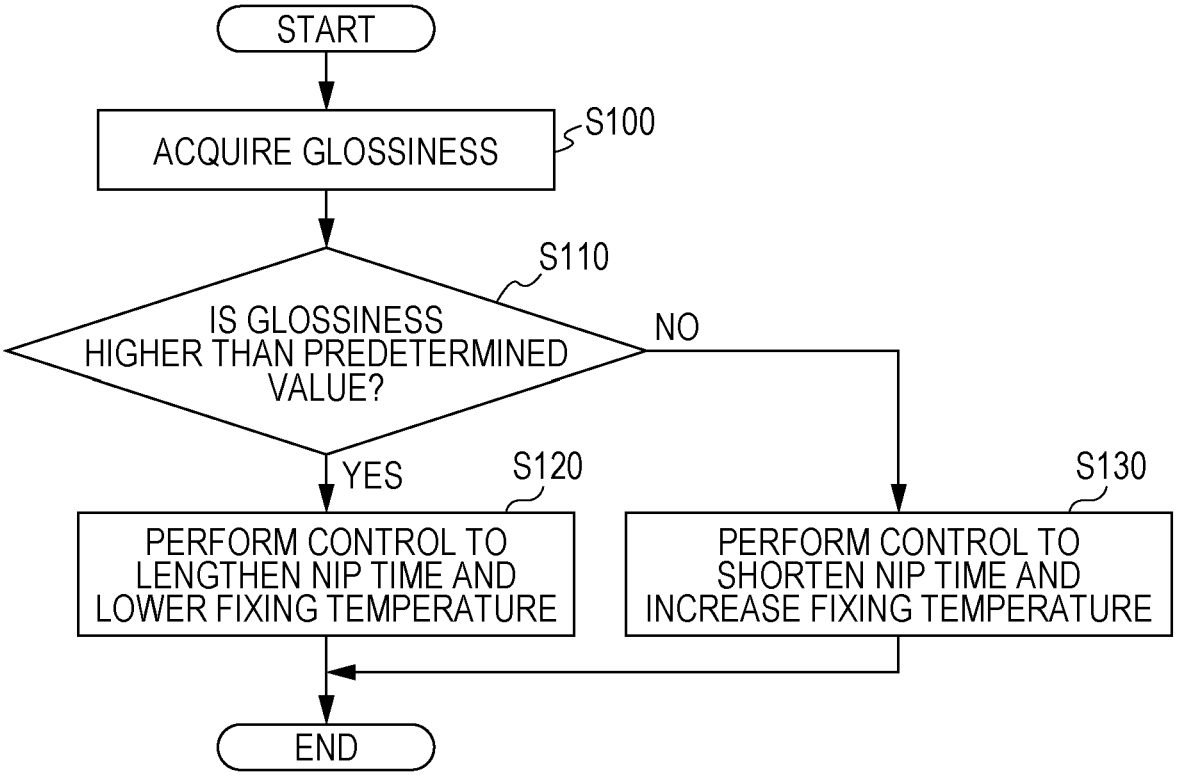
FIG. 4 is a flowchart showing an example of a nip width control method according to the present embodiment.

FIG. 4 is a flowchart showing an example of the fixing method according to the present embodiment. This flow is realized when the CPU 102 of the control part 101 executes a program recorded in the ROM 103.

First, in step S100, the control part 101 acquires glossiness.

Next, in step S110, the control part 101 determines whether or not the glossiness is higher than a predetermined value (a value in the normal mode). When the glossiness is higher than the predetermined value (step S110: YES), the process proceeds to step S120. When the glossiness is lower than the predetermined value (step S110: NO), the process proceeds to step S130.

In step S120, the control part 101 controls the heat sources 60C and 60D so as to lengthen the nip time and lower the fixing temperature of the toner. Thereafter, the process shown in FIG. 4 ends.

In step S130, the control part 101 controls the heat sources 60C and 60D so as to shorten the nip time and increase the fixing temperature of the toner. Thereafter, the process shown in FIG. 4 ends.

The fixing device in the above embodiment includes: the fixing belt 61 disposed on the fixing surface side on which a toner image is to be formed in the recording medium; the lower pressure roller 64 that is disposed on an opposite surface side to the fixing surface in the recording medium, and forms a fixing nip that nips and conveys the recording medium with the fixing belt 61; the heat sources 60C and 60D that heat the toner image formed on the recording medium passing through the fixing nip; the nip time changing part 610 capable of changing a nip time, which is a time required for the recording medium to pass through the fixing nip; and the control part 101 that controls the nip time changing part 610 and the heat sources 60C and 60D so as to shorten the nip time and increase the fixing temperature of the toner image when the glossiness of the toner image fixed on the recording medium is made lower than a predetermined value, and so as to lengthen the nip time and lower the fixing temperature of the toner image when the glossiness of the toner image is made higher than a predetermined value. When the glossiness of the toner image is made lower, the nip time is shortened and the fixing temperature is increased. Therefore, it is possible to suppress a decrease in productivity and an occurrence of a fixing failure. Further, when the glossiness of the toner image is made higher, the nip time is lengthened and the fixing temperature is lowered. Therefore, it is possible to inhibit and an excessive increase of the heating amount for the toner.

In the present embodiment, the nip time is controlled by controlling the nip width, but the nip time may be controlled by controlling the sheet passing linear speed. Note that, when the sheet passing linear speed is varied, it is desirable to control the nip time by controlling the nip width since the productivity changes. For example, when the sheet passing linear speed is reduced, the productivity is lowered. However, for example, in a case of an image quality priority mode in which image quality is prioritized over the productivity, the nip time may be controlled by lowering the sheet passing linear speed.

Example

Next, an example will be described.

The nip width is controlled by the nip pressure, and the nip time changes. For example, as the nip pressure is lowered, the nip time is reduced. By melting the toner in a short period of time, a toner shape is likely to remain, which reduces the glossiness. Conversely, as the nip pressure is increased, the nip time is increased. By melting the toner over a long period of time, a toner shape is less likely to remain, which increases the glossiness.

In this example, glossiness of a toner image in each glossiness mode was measured for each sheet type. For the measurement of glossiness, a 60 degree gloss meter (GM-60A manufactured by Konica Minolta) was used. As the sheet type, gloss coated 128 g paper, matte coated 186 g paper, color 300 g paper, and gloss coated 105 g paper were used.

Figure 6:
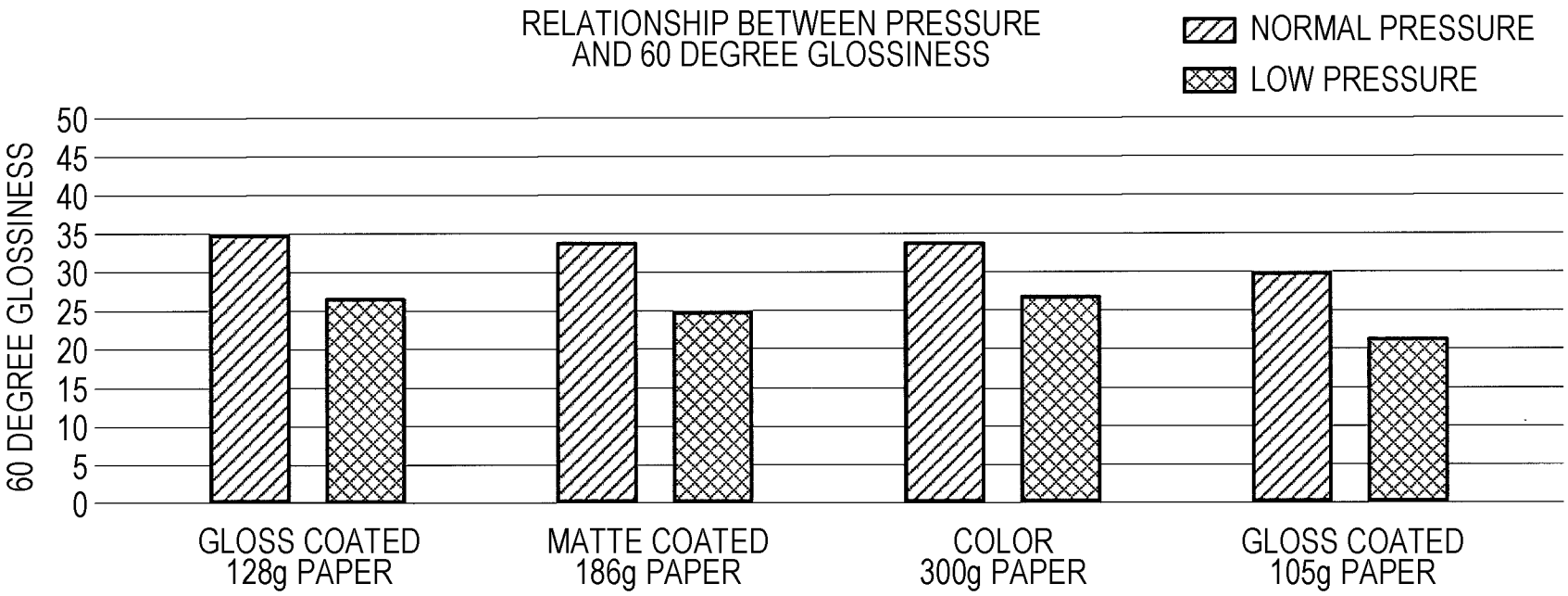
FIG. 6 is a graph showing an example of a relationship between a nip pressure and 60 degree glossiness when a fixing property is the same for each sheet type.

FIG. 5 is a view showing fixing conditions such as a fixing temperature in each glossiness mode. FIG. 6 is a graph showing a relationship between a nip pressure and 60 degree glossiness when a fixing property is the same for each sheet type. Here, the fixing property refers to an adhesive strength between a toner image and the sheet S. Further, the same fixing property means that the fixing temperature is controlled so that the adhesive strength between the toner image and the sheet S is the same in the low glossiness mode, the normal mode, and the high glossiness mode.

As shown in FIG. 5, in the low glossiness mode, the fixing temperature was 194° C., the nip time was 33 ms, the nip width was 15 mm, and the sheet passing linear speed was 460 mm/s. In the normal mode, the fixing temperature was 184° C., the nip time was 46 ms, the nip width was 21 mm, and the sheet passing linear speed was 460 mm/s. In the high glossiness mode, the fixing temperature was 174° C., the nip time was 50 ms, the nip width was 27 mm, and the sheet passing linear speed was 460 mm/s.

As shown in FIG. 6, the 60 degree glossiness in the low glossiness mode was 27 degrees for the gloss coated 128 g paper, 25 degrees for the matte coated 186 g paper, 27 degrees for the color 300 g paper, and 22 degrees for the gloss coated 105 g paper.

The 60 degree glossiness in the normal mode was 35 degrees for the gloss coated 128 g paper, 34 degrees for the matte coated 186 g paper, 34 degrees for the color 300 g paper, and 30 degrees for the gloss coated 105 g paper. Note that FIG. 6 does not show the 60 degree glossiness in the high glossiness mode.

From the above measurement result, it was found that a glossiness difference between the low glossiness mode and the normal mode was relatively large in the gloss coated 128 g paper, the matte coated 186 g paper, and the gloss coated 105 g paper. On the other hand, it was found that a glossiness difference between the low glossiness mode and the normal mode was relatively small in the color 300 g paper.

(Modification 1)

Figure 7:
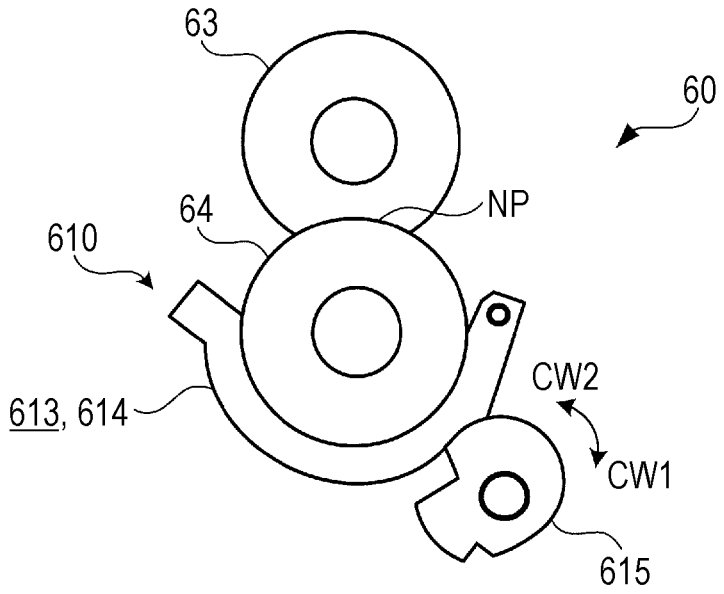
FIG. 7 is a view schematically showing an example of the fixing unit when a nip pressure is a low pressure.
Figure 8:
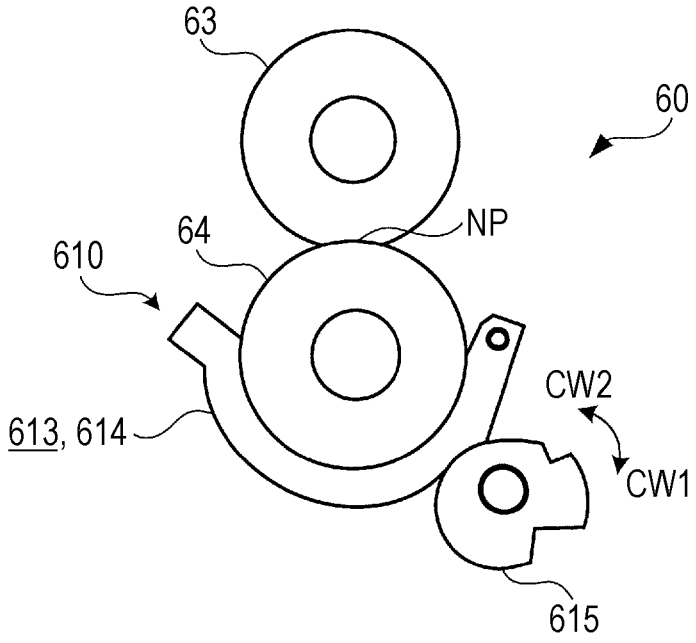
FIG. 8 is a view schematically showing an example of the fixing unit when a nip pressure is a normal pressure.

Next, Modification 1 of the present embodiment will be described with reference to FIGS. 7 and 8. FIG. 7 is a view schematically showing an example of the fixing unit 60 when a nip pressure is a normal pressure. FIG. 8 is a view schematically showing an example of the fixing unit 60 when the nip pressure is a low pressure.

As shown in FIGS. 7 and 8, the nip time changing part 610 according to Modification 1 has a nip pressure changing part 613 that can change a nip width by changing a nip pressure.

Note that, in Modification 1, the upper pressure roller 63 incorporates a heat source (not shown) such as a halogen heater. By controlling the heat source to control the upper pressure roller 63 to a predetermined temperature, the control part 101 controls a fixing temperature of toner. By pressure contact between the upper pressure roller 63 and the lower pressure roller 64, a fixing nip is formed.

The nip pressure changing part 613 has an arm 614, a cam 615, and an actuator (not shown).

The arm 614 is engaged with, for example, a rotation shaft of the lower pressure roller 64, as shown in FIG. 7. One end of the arm 614 extends to the right of the lower pressure roller 64. One end of the arm 614 is rotatably supported by the housing F. Another end of the arm 614 extends to the left of the lower pressure roller 64.

The cam 615 is arranged below the arm 614. The cam 615 is supported by the housing F so as to be rotatable around an axis. The cam 615 forms the fixing nip NP by pushing up the lower pressure roller 64, and changes a nip width by adjusting an amount of pushing up of the lower pressure roller 64. Specifically, when the cam 615 rotates in the clockwise direction CW1, the arm 614 is pushed upward and the nip pressure increases, which increases the nip width (see FIG. 7). When the cam 615 rotates in the counterclockwise direction CW2, the arm 614 moves downward and the nip pressure decreases, which reduces the nip width (see FIG. 8).

The actuator is formed by a known means such as, for example, a motor that rotates the cam 615 in the clockwise direction CW1 and the counterclockwise direction CW2 each. For example, a correspondence between a rotation amount of the motor and a nip width can be obtained by an experiment, a simulator, or the like. The control part 101 controls the rotation amount of the motor so that the nip width becomes a predetermined width.

The control part 101 controls the nip pressure changing part 613 so as to lower the nip pressure and reduce the nip width when the glossiness is made lower than the predetermined value. This makes it possible to lower the glossiness. The control part 101 controls the nip pressure changing part 613 so as to increase the nip pressure and increase the nip width when the glossiness is made higher than a predetermined value. This makes it possible to increase the glossiness.

Note that, the nip width may also be changed by changing the belt tension as in the above embodiment, in addition to changing the nip pressure as in Modification 1. This makes it possible to widen a range in which the nip width can be changed, for example.

(Modification 2)

Next, Modification 2 of the present embodiment will be described.

Due to a surface hardness of the fixing belt 61, a glossiness difference may not occur or a glossiness difference may be less likely to occur even when the nip time and the fixing temperature are changed. Further, the glossiness difference may differ depending on a sheet type and a basis weight of the sheet. Meanwhile, in general, the glossiness difference that can be visually recognized as having a difference in glossiness is 2 degrees. When the glossiness difference of 2 degrees is set as a reference, the surface hardness of the fixing belt 61 is desirably in a range of 80 degrees to 87.5 degrees. In other words, when the surface hardness of the fixing belt 61 is in the range of 80 degrees to 87.5 degrees, changing the nip time and the fixing temperature has an effect of producing a glossiness difference of 2 degrees or more.

On the other hand, when the surface hardness of the fixing belt 61 is in a low region of less than 80 degrees, a glossiness change due to the nip time is small, and the glossiness difference is small. Further, when the surface hardness of the fixing belt 61 is in a high region of exceeding 87.5 degrees, a glossiness change due to the fixing temperature becomes large, and, for example, as shown in FIG. 5, the fixing temperature is increased in the low glossiness mode, which reduces the glossiness difference. In other words, when the surface hardness of the fixing belt 61 is less than 80 degrees, or when the surface hardness of the fixing belt 61 exceeds 87.5 degrees, changing the nip time and fixing temperature does not have the effect of producing the glossiness difference of 2 degrees or more.

Example

Next, an example will be described. In this example, a 60 degree glossiness difference for each surface hardness of the fixing belt 61 was measured. Note that the surface hardness of the fixing belt 61 was measured with a micro hardness tester MD-1 capa (Type C, room temperature) manufactured by Kobunshi Keiki Co., Ltd. Here, the 60 degree glossiness difference means a difference between a 60 degree glossiness when the nip pressure is normal pressure and a 60 degree glossiness when the nip pressure is the low pressure.

Figure 9:
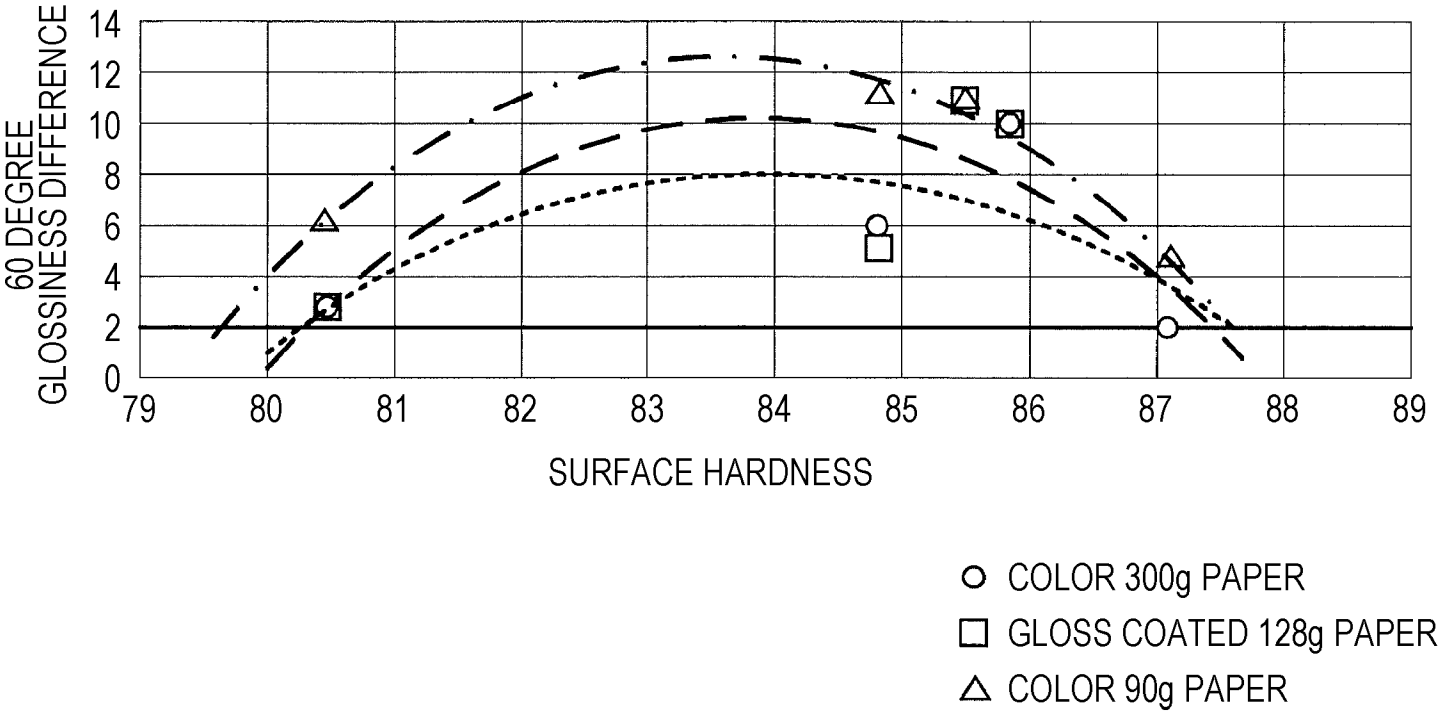
FIG. 9 is a graph showing an example of a relationship between a surface hardness of a fixing belt and a glossiness difference.

FIG. 9 is a graph showing of a relationship between a surface hardness of the fixing belt 61 and a 60 degree glossiness difference. A vertical axis in FIG. 9 indicates a 60 degree glossiness difference, and a horizontal axis indicates a surface hardness of the fixing belt 61. As shown in FIG. 9, a range of the surface hardness of the fixing belt 61 in a case where a 60 degree glossiness difference of 2 degrees or more occurs was in a range of 79.5 degrees to 87.5 degrees when the sheet type was color 90 g paper. Further, the range was from 80.5 degrees to 87.5 degrees when the sheet type was the gloss coated 128 g paper. Moreover, the range was 80.5 degrees to 87.5 degrees when the sheet type was color 300 g paper.

Further, in a range of the surface hardness of the fixing belt 61 when the 60 degree glossiness difference of 2 degrees or more occurs, the 60 degree glossiness difference of the color 90 g paper was the largest. The 60 degree glossiness difference of the gloss coated 128 g paper was the second largest. The 60 degree glossiness difference of color 300 g paper was the smallest.

From the above, it was found that changing the nip time and the fixing temperature of the toner image has the effect of producing the glossiness difference of 2 degrees or more when the surface hardness of the fixing belt 61 is in the range of 80 degrees to 87.5 degrees. On the other hand, it was found that changing the nip time and the fixing temperature of the toner image does not have the effect of producing the glossiness difference of 2 degrees or more when the surface hardness of the fixing belt 61 is in the range of less than 80 degrees, and in the range exceeding 87.5 degrees.

That is, it was found that the control part 101 is merely required to control the nip time changing part and the heat source so as to change the nip time and the fixing temperature of the toner image, on the basis of the range where the surface hardness of the fixing belt 61 is from 80 degrees to 87.5 degrees.

In addition, the following was found. In order to visually recognize that there is a glossiness difference, the surface hardness of the fixing belt is more desirably in the range of 81 to 86.5 degrees. From this point, it is desirable that the control part 101 controls the nip time changing part and the heat source so as to change the nip time and the fixing temperature of the toner image, on the basis of the range where the surface hardness of the fixing belt 61 is from 81 degrees to 86.5 degrees. Further, the surface hardness of the fixing belt 61 is desirably in the range of 79.5 degrees to 87.5 degrees depending on the sheet type and the basis weight of the sheet. From this point, it is desirable that the control part 101 controls the nip time changing part and the heat source so as to change the nip time and the fixing temperature of the toner image, on the basis of the range where the surface hardness of the fixing belt 61 is from 79.5 degrees to 87.5 degrees.

FIG. 10 is a view showing a fixing property, productivity, and gloss control when the surface hardness of the fixing belt 61 is low, medium, and high, and in Comparative Examples 1 and 2. Note that Comparative Example 1 is an example in which the glossiness is reduced by gloss control of reducing a nip time with a nip pressure in the low glossiness mode. Further, Comparative Example 2 is an example in which the glossiness is reduced while the fixing property is secured by gloss control of lowering a sheet passing linear speed in the low glossiness mode.

When the surface hardness of the fixing belt 61 was low, medium, or high, the productivity was favorable in the low glossiness mode since the nip pressure was reduced to shorten the nip time. Further, since the fixing temperature of the toner was made higher than a predetermined temperature, a heating amount for the toner did not decrease too much, and the fixing property was favorable. Further, the glossiness was reduced, the 60 degree glossiness became 2 degrees or more, and the gloss control was favorable. However, when the surface hardness of the fixing belt 61 was low and the surface hardness of the fixing belt 61 was less than 79.5 degrees, the 60 degree glossiness became less than 2 degrees, and the gloss control was not favorable. Further, when the surface hardness of the fixing belt 61 was high and the surface hardness of the fixing belt 61 exceeded 87.5 degrees, the 60 degree glossiness became less than 2 degrees, and the gloss control was not favorable.

In Comparative Example 1, the productivity was favorable since the sheet passing linear speed was not lowered. Further, since the nip time was shortened, the glossiness was reduced, the 60 degree glossiness became 2 degrees or more, and the gloss control was favorable. However, since the nip time was simply shortened, the heating amount for the toner was insufficient, a fixing failure occurred, and the fixing property was not favorable.

In Comparative Example 2, since the sheet passing linear speed was lowered, the glossiness decreased, the 60 degree glossiness became 2 degrees or more, and the gloss control was favorable. Further, since the sheet passing linear speed was lowered, the heating amount for the toner did not become insufficient, and the fixing property was favorable. However, the productivity was not favorable since the sheet passing linear speed was simply lowered.

(Modification 3)

Figure 11:
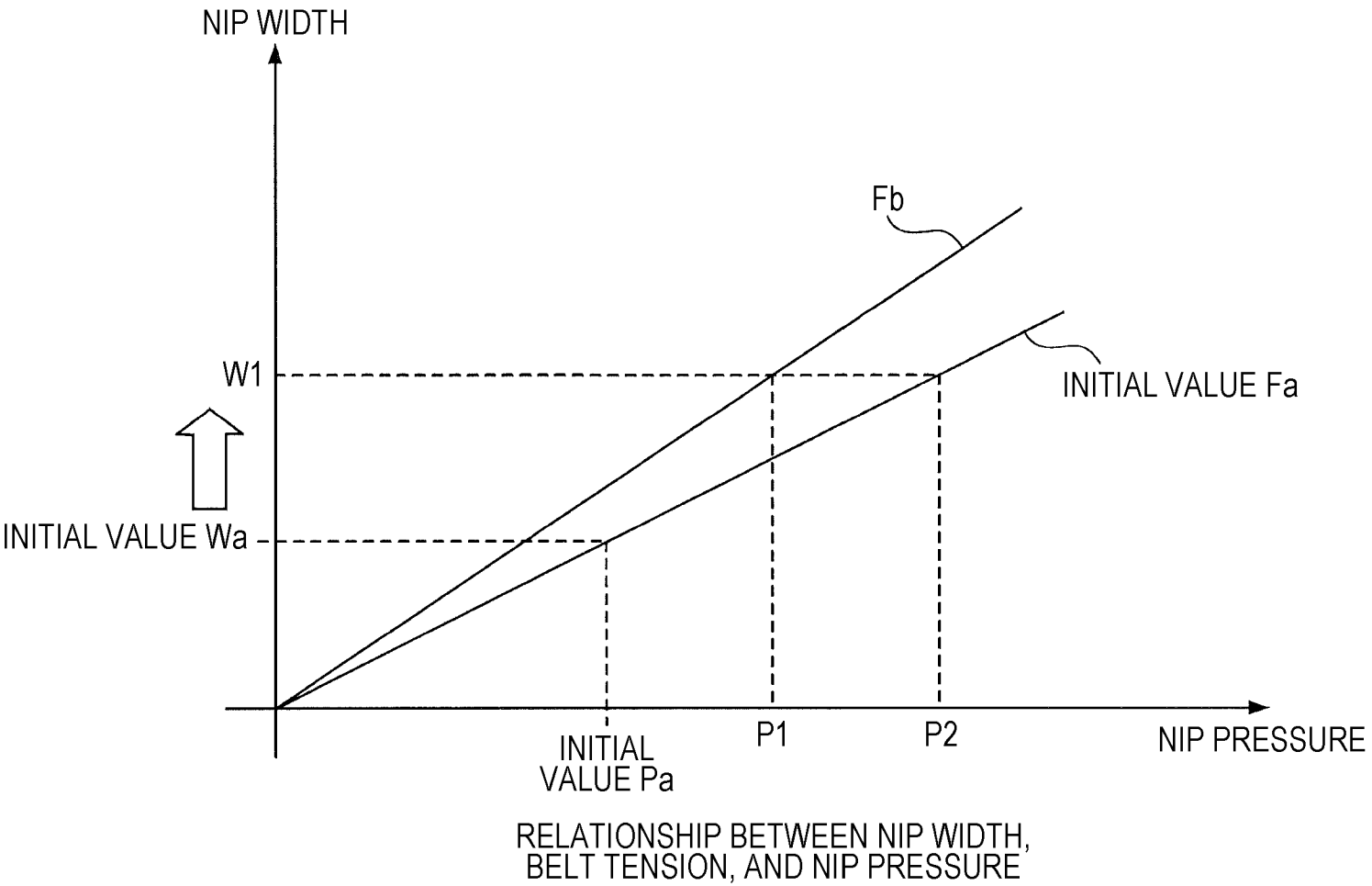
FIG. 11 is a graph showing an example of a relationship between a nip width, a belt tension, and a nip pressure.

Next, Modification 3 of the present embodiment will be described with reference to FIG. 11. FIG. 11 is a graph showing an example of a relationship between a nip width, a belt tension, and a nip pressure. In FIG. 11, a vertical axis indicates a nip width, and a horizontal axis indicates a nip pressure. Further, FIG. 11 shows an initial value Fa of the belt tension, a value Fb (<Fa) when the belt tension is weaker than the initial value Fa, an initial value Pa of the nip pressure, and an initial value Wa of the nip width.

Means that change the nip width include changing the nip pressure and changing the belt tension.

Meanwhile, in increasing the glossiness, an excessive increase of the nip pressure may cause a side effect such as "soaking".

In Modification 3, when the glossiness is made higher than a predetermined value (when widening the nip width), the control part 101 controls the nip time changing part 610 so that the belt tension decreases and the nip pressure changes in accordance with the decreased belt tension, and controls the heat source so as to lower the fixing temperature of the toner. This makes it possible to increase the glossiness.

Further, when the glossiness is made lower than a predetermined value (when narrowing the nip width), the control part 101 controls the nip time changing part 610 so that the belt tension increases and the nip pressure changes in accordance with the increased belt tension, and controls the heat source so as to increase the fixing temperature of the toner. This makes it possible to lower the glossiness.

In this Modification 3, as shown in FIG. 11, when widening the nip width from the initial value Wa to W1, the control part 101 controls the nip time changing part 610 so as to reduce the belt tension from the initial value Fa to Fb (<Fa), and change the nip pressure from the initial value Pa to P1 in accordance with the decreased belt tension.

On the other hand, when widening the nip width from the initial value Wa to W1, it is also possible to control the nip time changing part 610 so as to maintain the belt tension at the initial value Fa, and increase the nip pressure from the initial value Pa to P2 (>P1). However, in this case, the nip pressure may be excessively increased.

In Modification 3, since the nip width can be widened without an excessive increase of the nip pressure (since the nip time can be lengthened), it is possible to increase the glossiness while suppressing a side effect (soaking). In other words, in Modification 3, it is possible to increase the glossiness while suppressing the side effect, by using the belt tension and the nip pressure together.

In addition, each of the above embodiments is merely an example of implementation in carrying out the present invention, and the technical scope of the present invention should not be construed in a limited manner by these. That is, the present invention can be implemented in various forms without departing from the scope or main features of the present invention.

For example, the control for changing the nip width and the control on the heat source may be performed so as to increase the nip width of the fixing nip and lower the fixing temperature of the toner image when the glossiness required for the toner image is high, and so as to reduce the nip width of the fixing nip and increase the fixing temperature of the toner image when the glossiness required for the toner image is low. Further, in this case, the sheet passing linear speed may be constant.

Although embodiments of the present invention have been described and illustrated in detail, the disclosed embodiments are made for purposes of illustration and example only and not limitation. The scope of the present invention should be interpreted by terms of the appended claims

What is claimed is:

1. A fixing device comprising:

a fixing-surface-side member disposed on a fixing surface side on which a toner image is to be formed in a recording medium;

a back-surface-side support member that is disposed on an opposite surface side to the fixing surface in the recording medium, and forms a fixing nip that nips and conveys the recording medium with the fixing-surface-side member;

a heat source that heats the toner image formed on the recording medium passing through the fixing nip;

a nip time changing part that can change a nip time that is a time required for the recording medium to pass through the fixing nip; and a hardware processor that controls the nip time changing part and the heat source to shorten the nip time and increase a fixing temperature of the toner image when glossiness of the toner image fixed on the recording medium is made lower than a predetermined value, and to lengthen the nip time and lower a fixing temperature of the toner image when glossiness of the toner image is made higher than a predetermined value.

2. The fixing device according to claim 1, wherein a surface hardness of the fixing-surface-side member is 80 degrees or more and 87.5 degrees or less.

3. The fixing device according to claim 1, wherein the nip time changing part changes the nip time by changing a nip width.

4. The fixing device according to claim 3, wherein the fixing-surface-side member is a belt that is stretched under tension between at least two members, and the nip time changing part has a tension changing part that can change the nip width by changing a tension of the belt.

5. The fixing device according to claim 3, wherein the nip time changing part has a nip pressure changing part that can change the nip width by changing a nip pressure of the fixing nip.

6. The fixing device according to claim 4, wherein the nip time changing part further changes a nip pressure of the fixing nip by changing a tension of the belt.

7. An image forming apparatus comprising:

the fixing device according to claim 1; and an image forming part that forms the toner image on the recording medium.

8. A fixing method comprising:

shortening a nip time that is a time required for a recording medium to pass through a fixing nip and increasing a fixing temperature of a toner image, when making glossiness of the toner image fixed on a recording medium lower than a predetermined value; and lengthening the nip time and lowering a fixing temperature of the toner image, when making glossiness of the toner image higher than a predetermined value.

* * * * *